United States Patent [19]

Kiefer et al.

[11] Patent Number: 4,808,976

[45] Date of Patent: Feb. 28, 1989

[54] TORQUE INDICATOR

[75] Inventors: Walter J. Kiefer, Seattle; Michael R. Cross, Everett, both of Wash.

[73] Assignee: Kiefers, Ltd., Lynnwood, Wash.

[21] Appl. No.: 211,760

[22] Filed: Jun. 27, 1988

Related U.S. Application Data

[63] Continuation of Ser. No. 50,681, May 18, 1987.

[51] Int. Cl.[4] ..... G08B 21/00

[52] U.S. Cl. ..... 340/665; 73/862.23; 81/479; 307/124

[58] Field of Search ..... 340/665; 73/862.23; 307/124; 81/479, 478, 477

[56] References Cited

U.S. PATENT DOCUMENTS

| | | | |
|---|---|---|---|
| 3,481,193 | 12/1969 | Schubert | 73/139 |
| 3,546,932 | 12/1970 | Thomasian | 73/139 |
| 3,691,826 | 9/1972 | Grabovac | 73/139 |
| 3,945,704 | 3/1976 | Kraus et al. | 339/97 |
| 4,314,490 | 2/1982 | Stone | 81/479 |
| 4,418,590 | 12/1983 | Dubiel et al. | 81/467 |
| 4,569,234 | 2/1986 | F'Geppert | 73/862.19 |

*Primary Examiner*—Glen R. Swann, III

*Attorney, Agent, or Firm*—Stoel Rives Boley Jones & Grey

[57] ABSTRACT

A torsion member (12) has opposing protruding end elements (4, 6) configured for transmitting torque therebetween. A first contact mechanism (20, 26) is mounted to a surface (10) of one end (4) of the torsion member (12). The first contact mechanism includes a movable contact (26') disposed between the end elements (4, 6) of the torsion member. A second contact mechanism (18, 28) is mounted to a surface (11) of the other end element (6) of the torsion member (12). The second contact mechanism includes a movable contact (28') disposed near the first contact (26'). The first contact (26') and second contact (28') move toward each other whenever torsion is applied to the torsion member (12). Means (30, 40) are provided for changing the distance between the first and second contacts (26', 28'), and for producing a signal whenever the first and second contacts touch.

8 Claims, 3 Drawing Sheets

TORQUE INDICATOR

This is a continuation of application Ser. No. 07/050,681, filed May 18, 1987.

TECHNICAL FIELD

This invention relates to a torque indicator and, in particular, to a torque indicator that produces a signal to advise the operator that a desired torsional force has been delivered to the workpiece.

BACKGROUND INFORMATION

Torque indicators commonly include torque receiving means to which torsional force is applied, torque delivering means for delivering the applied force to the workpiece, and intermediate means, such as a torsion rod, interconnected therebetween. The torsional force delivered to the workpiece may be assumed to be the same as that applied to the torque receiving means, or it may be assumed that there is a differential between the applied force and the delivered force, such as where a torque multiplier is used in conjunction with the torque indicator.

It is desirable to know what the delivered force actually is and whether it corresponds to that desired. Numerous prior art torque indicators have been provided for this purpose, but they typically employ elongated bending beams or other external connections that render the devices unwieldy and difficult to use in small spaces. Further, such prior devices are permanently attached to the wrench or power drive used for applying the torque, thereby limiting the use of the torque indicator to that particular wrench or power drive.

SUMMARY OF THE INVENTION

The torque indicator of the present invention is a compact and versatile device for selecting the precise amount of torque to be applied to a workpiece. The indicator can be used to transmit torque with or without a torque multiplier mechanism and it can be used with all types of torque applicator means, including common manually operable ones such as: ratchet wrenches and tee head or ell head breaker bars. The present invention is especially adapted for use with short-length hand wrenches and torque multipliers.

The torque indicator of the present invention particularly comprises a torsion member having opposed end elements. A mounting surface is formed in each end element. Each mounting surface carries a contact mechanism. The contact mechanisms include contacts that are configured and arranged to move toward each other when torque is applied to the torsion member. Also included is a selector mechanism for altering the distance between the contacts in accordance with a selected torque setting on an attached dial. A signal is produced whenever the contacts touch each other in response to the movement imparted when the selected torque is applied to the torsion member.

As another aspect of this invention, there is provided means for fine adjustment of the distance between the two contacts, to thereby permit selection of the precise amount of torque to be applied by the device.

As another aspect of this invention, there is included a rotatable torque indicator dial between the end elements of the torsion member that is configured to enclose the contact mechanisms.

DETAILED DESCRIPTION OF PREFERRED EMBODIMENTS

Figures 1, 2, 5:
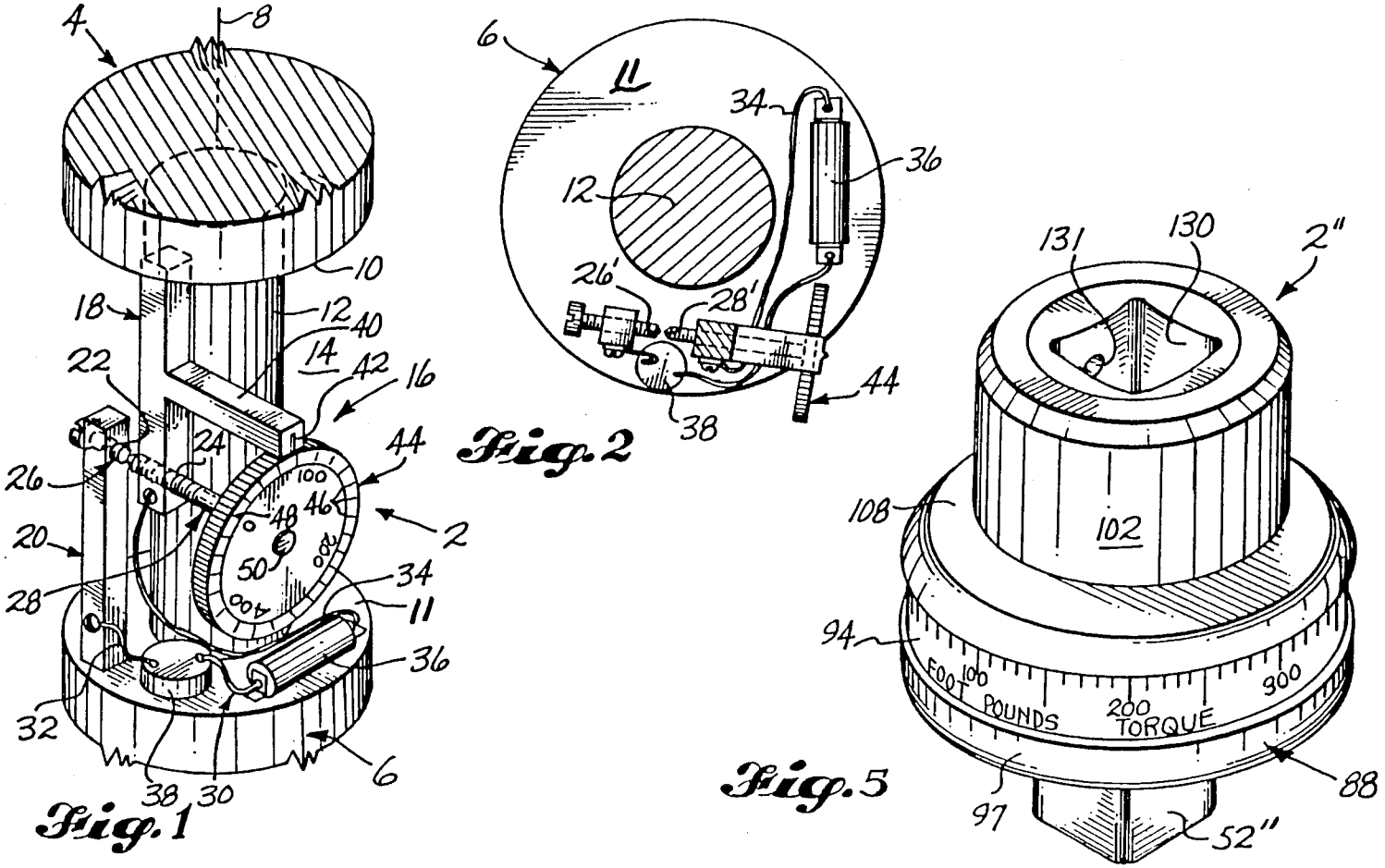
FIG. 1 is a part perspective view of a torque indicator of the present invention illustrating the contact and alarm-producing mechanisms.
FIG. 2 is a cross-sectional view transverse the torsional axis of the indicator shown in FIG. 1.
FIG. 5 is a perspective view of a third embodiment of a torque indicator.

Referring first to the embodiment in FIGS. 1 and 2, it will be seen that the device 2 includes a pair of apart-spaced cylindrical elements 4 and 6. The elements 4, 6 are interconnected by a cylindrical torsion rod 12. The elements 4, 6 and torsion rod 12 share a common axis 8. The torsion rod 12 has a smaller diameter than the elements 4, 6.

One element 4 serves as the means for receiving torque, and the other element 6 serves as the means for delivering torque to the workpiece (not shown). The means by which the torque-receiving element 4 is engaged to receive torque, and the means by which the torque-delivering element 6 is engaged with the workpiece are not shown. Torque is applied to the torque-receiving element 4 and transmitted to element 6 by the rod 12 for delivery to the workpiece. It is contemplated that, in some applications, the device 2 may be inverted so that element 6 serves as the torque-receiving element and element 4 as the torque-delivering element.

The elements 4 and 6 have opposing surfaces 10, 11, respectively, formed thereon. The surfaces 10, 11 are disposed in planes that are at right angles to the axis 8. A gap 14 is defined between the opposed surfaces 10, 11 of the elements 4, 6. The gap 14 between the surfaces 10, 11 accommodates a torque-indicating mechanism 16, which is described next.

The surface 10 of element 4 has a strut-like support 18 extending therefrom. The surface 11 of element 6 has a similar strut-like support 20 extending therefrom. The ends of the supports 18, 20 that are away from surfaces 10, 11 are spaced from one another, but overlap in the direction parallel to the axis 8. The supports 18 and 20 are radially spaced from the rod 12.

A right-handed threaded hole 22, 24 is formed in the end of each support 20, 18, respectively. The central axes of the holes 22, 24 are tangent to a common radius and are located midway between the surfaces 10, 11. A screw 26 is threaded through the hole 22 so that when it is advanced through the support 20, its tip 26' approaches the other support 18. A relatively longer screw 28 is threaded through hole 24 so that when it is advanced through the support 18, its tip 28' approaches the tip 26' of the other screw 26.

The shorter screw 26 preferably serves as a substantially fixed contact, as will be explained. The longer screw 28 serves as a displaceable contact, as will also be explained.

Both screws 26, 28 are electrically conductive and insulated from one another, as are the supports 18 and 20. The screws 26, 28 and supports 18, 20 are part of an electrical circuit 30 that includes a pair of electrical leads 32, 34 connected to the supports. The leads 32, 34 are interconnected in series by a battery 36 and an electrically activated alarm 38 that is mounted on the surface 11 of the torque-delivering element 6. The alarm 38 is activated when the two screw tips 26' and 28' contact one another to complete the circuit 30, as will be explained.

Extending from the midpoint of support 18 is an arm 40 that has a witness mark 42 at the end thereof. Attached to the outlying end of the longer screw 28 is a dial 44. The dial 44 is calibrated with respect to the mark 42 to represent a range of torsional forces that may be applied by the device 2. The calibration range commences with a zero setting 48. This setting represents the position where the tips 26' and 28' of the screws will touch with no torque applied to the torque-receiving end 4. To adjust the dial 44 to the zero setting, the dial 44 is secured to the end of the screw 28 by an attachment screw 50. After the tips 26', 28' are brought together, the screw 50 can be loosened and the dial 44 rotated until the zero setting 48 and the mark 42 coincide. At this setting, the screw 50 may be tightened to fix the location of the dial 44 with respect to the mark 42. When it is so fixed, the dial 44 becomes a handle for rotating the screw 28 to advance and retract the tip 28' of the screw 28.

Whenever torsional force is applied in the clockwise direction (as viewed in plan) to the torque-receiving element 4, and if the torque-delivering element 6 is fixed on the workpiece, the tip 28' of the longer screw 28 rotates about the rod 12 toward the tip 26' of the shorter screw 26. It can be appreciated that there is a correlation between the distance the screw tip 28' moves relative to the other tip 26' and the magnitude of the applied torsion force that produces that movement.

According to the invention, dial 44 is configured, and the thread pitch of the longer screw 28 is selected, so that the rotation of the dial 44 between the zero setting 48 and any selected torque setting 46 displaces the tip 28' of the screw 28 in relation to the other tip 26' a distance corresponding to the magnitude of the torsional force represented by the selected setting 46. The magnitude of this distance is also a function of the size of the rod 12 and the position of the supports 18, 20 and screws 26, 28 relative to the rod 12.

To ready the device for use, the dial 4 is rotated counterclockwise to the desired torque setting to thereby retract the tip 28' from the tip 26' the distance corresponding to the distance the tip 28' will move toward tip 26' when the applied torsional force is equal to the setting. Whenever the selected torque is applied, the screw tips recontact and the alarm 38 is activated to apprise the operator that the desired maximum torque has been reached at the workpiece.

Figure 4:
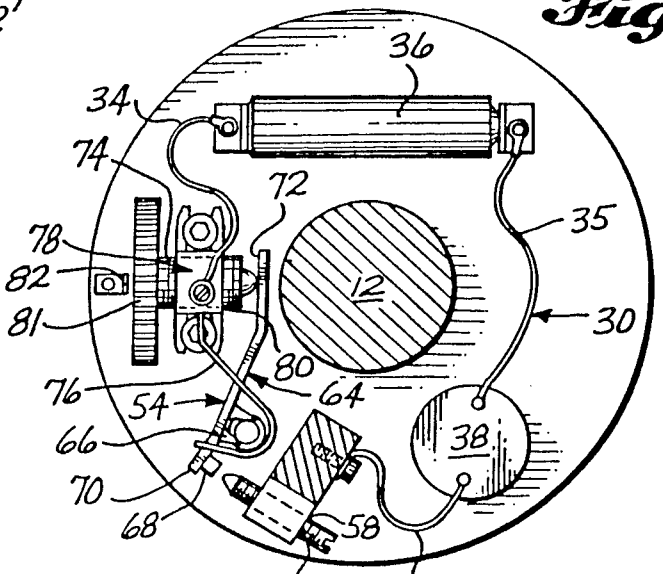
FIG. 4 is a cross-sectional view transverse the torsional axis of the indicator of FIG. 3.
Figure 3:
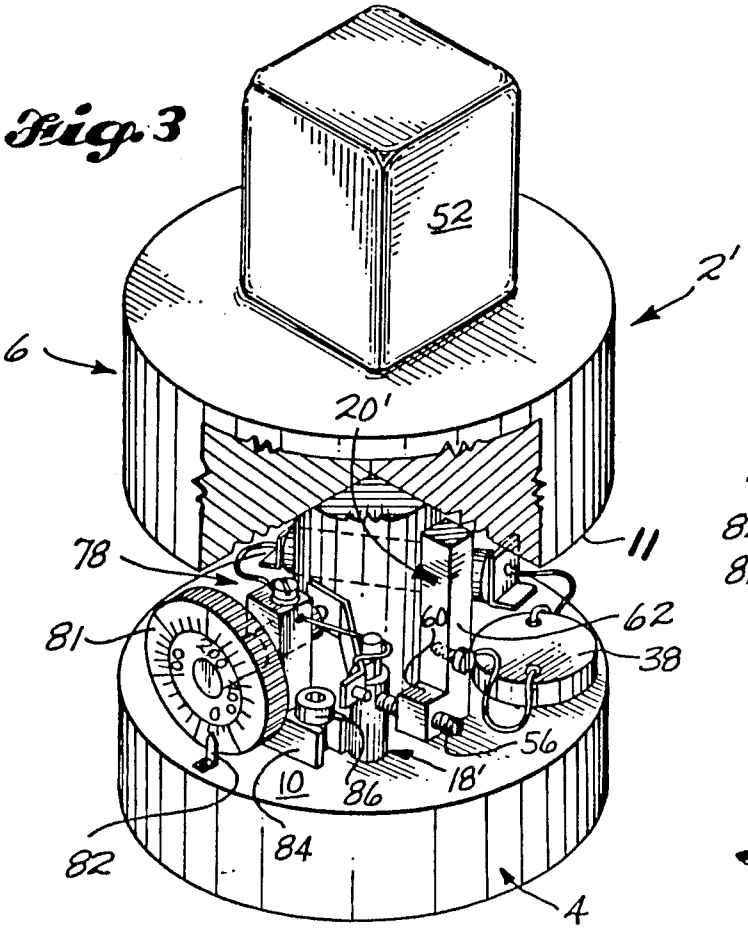
FIG. 3 is a perspective view of a second embodiment of a torque indicator.

The embodiment in FIGS. 3 and 4 includes means with which to achieve fine adjustment of the selected torque levels and, hence, a high degree of accuracy in the device 2'. With this embodiment, the torque-receiving element 4 and the torque-delivering element 6 are reversed from their positions shown in FIGS. 1 and 2. Further, the torque-delivering element 6 is equipped with a lug 52 for engagement with a workpiece, such as a socket. The elements 4 and 6 have a pair of strut-like supports 18' and 20' extending from opposing surfaces 10, 11, respectively, and radially spaced from the rod 12.

In this embodiment, the support 18' on the torque-receiving element 4 takes the form of a post having a top groove, which serves as a fulcrum for the corresponding contact mechanism 54. The support 20' is attached to and electrically insulated from the torque-delivering element 6. The support 20' is L-shaped and has a screw 56 threaded through a hole 58 that is formed in the shorter leg 60 of the support 20'. That leg 60 extends right-angularly from the main leg 62 of the support 20'.

Contact mechanism 54, described more fully below, is part of an electrical circuit 30 that includes a battery 36 and alarm 38. Electrical leads 32, 34 and 35 interconnect the components of the circuit as in the embodiment of FIGS. 1 and 2.

The contact mechanism 54 includes a bell crank lever 64 that has a cleat 66 carried thereon. The cleat 66 has a concave bearing surface upon which the lever pivots about the top of the support 18'. The lever 64 also has a contact button 68 on one side of the outer end 70 thereof. The contact button 68 faces the screw 56 in the support 20'.

One side of the inner end 72 of the lever 64 is contacted by the tip of a dial-driven screw 74 that is threaded through on auxiliary support 78. The screw 74 operates as a worm drive mechanism for the lever 64. The auxiliary support 78 is adjustably mounted on the surface of torque-receiving element 4.

The lever 64 is pivotally mounted on the support 18' so that the contact button 68 is yieldably biased toward engagement with the screw 56 on the support 20'. The lever is biased by a wire spring 76 that has one end attached to the auxiliary support 78. The spring 76 extends from the auxiliary support 78 to wrap around the support 18' and terminate n the side of the lever end 70 that is opposite the contact button 68, as seen in FIG. 4.

The screw 74 that contacts the inner end 72 of the lever 64 is driven by the dial 81 and extends through a hole 80 in the auxiliary support 78. Accordingly, rotation of the dial 81 pivots the lever against the bias thereon to increase or decrease the space between contact button 68 and screw 56.

The lever 64 is configured and arranged so that the outer end 70 is nearer the pivot support 18' than is the inner end 72. Consequently, the difference in radius between the arcs swung by the outer end 70 and by the inner end 72 generates a differential effect between the movement of the screw 74 and the movement of the contact button 68 on the lever. This effect is employed to provide a fine adjustment in the distance between the button 68 and the screw 56, but can be employed for other purposes, if desired. Moreover, the auxiliary support 78 is equipped with lateral feet 84 by which it is secured in place with cap screws 86. The feet 84 of the auxiliary support are slotted so that on loosening the screws 86, the support 78 can be shifted lengthwise of the lever to vary the radius of the arc swung by the point of contact between the lever 64 and the screw 74. Therefore, the differential effect can also be varied if desired, for example, in calibrating the device.

Figures 6, 7:
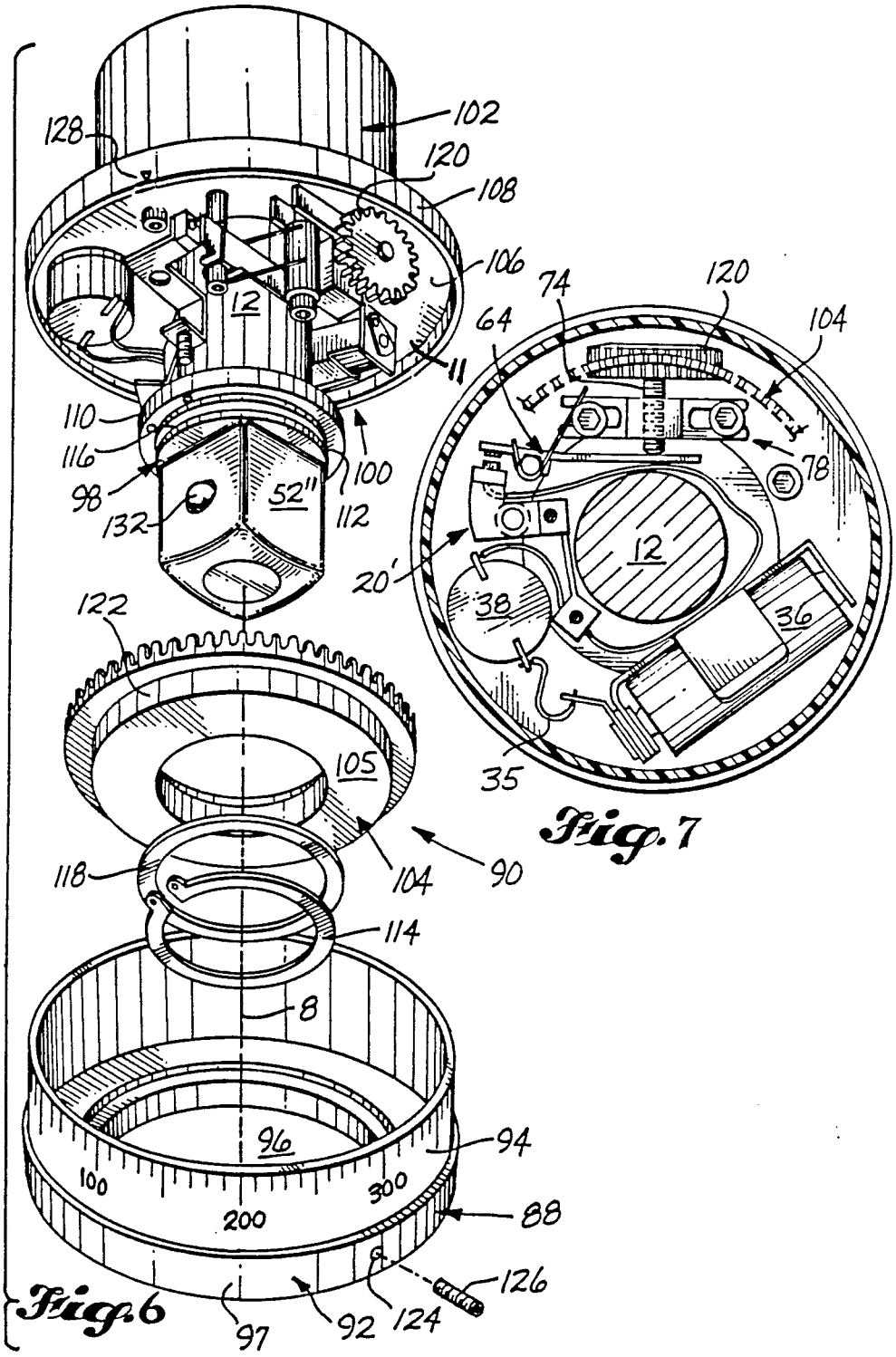
FIG. 6 is an exploded perspective view of the third embodiment.
FIG. 7 is a cross-sectional view transverse the torsional axis of the indicator of FIG. 6.

In the embodiment of FIGS. 5–7, the device 2" is similar to that of FIGS. 3 and 4, but in lieu of the dial 81, the device in FIGS. 5–7 has rotary torque selector 88 that is rotatable about an axis parallel to the axis 8 of the rod 12. The torque selector 88 includes an attached dial 94 and is connected to a drive transmission 90. Rotation of the dial 94 by the user causes the drive transmission 90 to extend or retract the screw 74, hence changing the amount of torque that can be applied before the alarm is activated.

Referring to FIGS. 6 and 7 in particular, the rotary torque selector 88 includes a thimble-like rotor 92 to which the annular dial 94 is attached. The rotor 92 has a rabbeted central opening 96. The rotor 92 is carried on the device 2'' near the torque-delivering end 98 thereof. The drive transmission 90 is interposed between the rotor 92 and a selector mechanism 100 that is mounted near the torque-receiving end of the device.

The drive transmission 90 includes an annular crown gear 104 that is rabbeted about the periphery of the face 105 that is opposite the geared face. The rabbeted face 105 mates with the rabbetted central opening 96 of the rotor 92. In order that the rotor 92 and gear 104 can mate with the torque-receiving end 102 of the device, that end 102 has a wide diameter extension 106 of the surface 11 thereof, which extension has a raised parapet 108 about the outer periphery thereof. The end 97 of the rotor 92 corresponds in outside diameter to that of the parapet 108, whereas the edge of the dial 94 fits within the parapet 108.

The torque-delivering end 98 of the device constitutes an annular flange 110 on the torsion rod 12. The flange 110 has a neck or shank 112 with a diameter that is the same as that of a circle that circumscribes the lug 52''. When the device is assembled (FIG. 5), the crown gear 104 fits about the shank 112 and abuts the flange 110. A snap ring 114 is then engaged in a circumferential groove 116 about the shank 112 to retain the gear on the flange. Preferably, a washer 118 is interposed between the face 105 and the ring 114 to aid in the rotation of the gear 104.

The selector mechanism 100 is similar to that seen in FIGS. 3 and 4, but has a pinion gear 120 substituted for the dial 81 of the screw 74 in the worm drive mechanism of FIGS. 3 and 4. The pinion gear 120 is positioned to mesh with the crown gear 104 when the latter gear abuts the flange 110.

The rotor 92 has a hole 124 therein by which a set screw 126 can be interengaged with the rabbet 122 of the crown gear to lock the two together. This is normally done, however, only after the zero setting (not shown) on the dial 94 has been aligned with a witness mark 128 on the parapet 108 of the torque-receiving end 102 of the device, to ready the device for use.

The torque-receiving end 102 of the device also has a socket 130 formed therein (FIG. 5) by which a male/-female connection can be made between the device and the torque applicator (not shown). The socket 130 has a recess 131 which will receive a button such as 132 on lug 52'' (FIG. 6). The lug 52'' on the torque delivering end 98 has a yieldably biased button which, along with recess 131 cooperatively engages with the counterparts on the applicator and the workpiece to provide detents for the respective connections.

Figure 8:
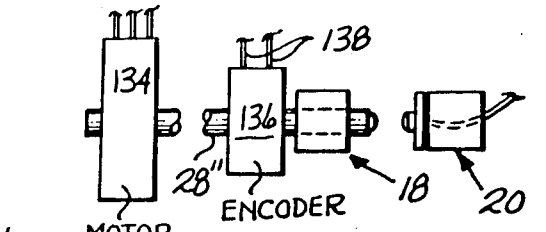
FIG. 8 is a schematic illustration of further features that can be employed in conjunction with the selector mechanisms of the three embodiments.

If desired, the screws 28 and 74 of the three embodiments can be driven from a remote point outside the device by a motor 134 in the manner of FIG. 8 wherein the motor is shown schematically at the end of screw 28''. In such a case, the screw is normally also equipped with encoder means 136 by which a signal is fed through electrical leads 138 to indicate the rotation of the screw which is correspondingly converted to read the torque setting.

We claim:

1. A torque indicator comprising:

(a) a torsion member;

(b) a first element attached to the torsion member and having a first mounting surface protruding outwardly from the torsion member;

(c) a second element attached to the torsion member and having a second mounting surface protruding outwardly from the torsion member, the second mounting surface being spaced from the first mounting surface;

(d) a first contact mechanism mounted to the first mounting surface and carrying a first contact disposed between the first and second mounting surfaces;

(e) a second contact mechanism mounted to the second mounting surface and carrying a second contact disposed between the first and second mounting surfaces, the first and second contacts configured and arranged to move toward each other when torque is applied to the torsion member;

(f) selector means for altering the distance between the first contact and the second contact, and for providing a signal whenever the first contact touches the second contact.

2. The indicator of claim 1 wherein the selector means includes fine adjustment means comprising:

(a) a lever pivotally mounted about a fulcrum axis adjacent to the first mounting surface, the lever having a first end to which the first contact is attached, and a second end;

(b) dial means mounted near the second end of the lever for applying a displacement force to the second end of the lever at a selected distance from the fulcrum axis to thereby move the first contact relative to the second contact.

3. The indicator of claim 2 wherein the dial means is adjustably mounted to permit changing the selected distance from the fulcrum axis.

4. A torque indicator comprising:

(a) a torsion member having a first end configured for receiving torque and a second end configured for delivering the torque to a workpiece;

(b) a first flange attached to the torsion member near one end thereof;

(c) a second flange attached to the torsion member near the other end thereof and spaced from the first flange;

(d) torque indicating means mounted to the first and second flanges for selecting a torque limit and for producing a signal whenever the amount of torque applied to the torsion member reaches the torque limit.

5. The indicator of claim 4 wherein the torque indicating means includes indicia-carrying dial means mounted to substantially enclose the space between the two flanges and for changing the torque limit.

6. The indicator of claim 5 wherein the torque indicating means includes:

(a) a lever pivotally mounted about a fulcrum axis to one flange, the lever having a first end to which a first contact is attached, and a second end;

(b) a second contact mounted near the first contact, the signal being produced whenever the first and second contacts touch; and (c) lever drive means associated with the dial means for applying a displacement force to the second end of the lever at a selected distance from the fulcrum axis to thereby move the first contact relative to the second contact.

7. The indicator of claim 6 wherein the lever drive means is adjustably mounted to one flange for permitting changes to the selected distance from the fulcrum axis.

8. The indicator of claim 4 wherein the torsion member is a solid cylindrical rod and the first and second flanges are integrally formed therewith.

* * * * *